US011795414B2

(12) United States Patent
Rittig et al.

(10) Patent No.: US 11,795,414 B2
(45) Date of Patent: Oct. 24, 2023

(54) METALWORKING FLUID CONTAINING A BRANCHED ALCOHOL PROPOXYLATE

(71) Applicant: BASF SE, Ludwigshafen am Rhein (DE)

(72) Inventors: Frank Rittig, Ludwigshafen am Rhein (DE); Marcel Harhausen, Ludwigshafen am Rhein (DE); Thorsten Schoeppe, Ludwigshafen am Rhein (DE); Marcus Leubner, Ludwigshafen am Rhein (DE); Lu Yi Zhang, Shanghai (CN); Markus Hansch, Ludwigshafen am Rhein (DE); Kian Molawi, Ludwigshafen am Rhein (DE); Jan Strittmatter, Ludwigshafen am Rhein (DE)

(73) Assignee: BASF SE

( * ) Notice: Subject to any disclaimer, the term of this patent is extended or adjusted under 35 U.S.C. 154(b) by 0 days.

(21) Appl. No.: 17/602,871

(22) PCT Filed: Apr. 1, 2020

(86) PCT No.: PCT/EP2020/059319
§ 371 (c)(1),
(2) Date: Oct. 11, 2021

(87) PCT Pub. No.: WO2020/207881
PCT Pub. Date: Oct. 15, 2020

(65) Prior Publication Data

US 2022/0162514 A1 May 26, 2022

(30) Foreign Application Priority Data

Apr. 12, 2019 (WO) ..... PCT/CN2019/082439

(51) Int. Cl.

| | |
|---|---|
| ***C10M 145/36*** | (2006.01) |
| ***C10M 145/30*** | (2006.01) |
| ***C10M 173/02*** | (2006.01) |
| *C10N 20/00* | (2006.01) |
| *C10N 50/00* | (2006.01) |
| *C10N 20/02* | (2006.01) |
| *C10N 30/18* | (2006.01) |
| *C10N 40/22* | (2006.01) |
| *C10N 40/24* | (2006.01) |

(52) U.S. Cl.
CPC ..... *C10M 145/36* (2013.01); *C10M 145/30* (2013.01); *C10M 173/02* (2013.01); *C10M 2209/1055* (2013.01); *C10M 2209/1085* (2013.01); *C10N 2020/02* (2013.01); *C10N 2020/071* (2020.05); *C10N 2030/18* (2013.01); *C10N 2040/22* (2013.01); *C10N 2040/24* (2013.01); *C10N 2050/01* (2020.05)

(58) Field of Classification Search
CPC ..... C10M 145/36; C10M 2209/105; C10M 2209/108; C10M 2209/1055; C10M 2209/1085; C10M 2209/104; C10M 173/00; C10M 2203/1006; C10M 2203/1065; C10M 2207/046; C10M 2207/128; C10M 2207/18; C10M 2207/30; C10M 2215/042; C10M 2215/082; C10N 2020/02; C10N 2020/071; C10N 2030/00; C10N 2030/06; C10N 2030/18; C10N 2030/24; C10N 2040/20; C10N 2040/24; C10N 2050/01
See application file for complete search history.

(56) References Cited

U.S. PATENT DOCUMENTS

| | | | | |
|---|---|---|---|---|
| 4,830,768 | A | 5/1989 | Reich et al. | |
| 5,741,947 | A | 4/1998 | Wolf et al. | |
| 2003/0187114 | A1 | 10/2003 | Breitscheidel et al. | |
| 2017/0107440 | A1* | 4/2017 | Cuff | B05D 1/30 |
| 2017/0175030 | A1 | 6/2017 | Jibiki et al. | |
| 2019/0345402 | A1* | 11/2019 | Zorn | C10L 1/18 |

FOREIGN PATENT DOCUMENTS

| | | | |
|---|---|---|---|
| DE | 4325237 | A1 | 2/1995 |
| DE | 10243361 | A1 | 4/2004 |
| EP | 3049500 | A1 | 8/2016 |
| GB | 0601604 | A | 5/1948 |
| WO | 03/66706 | A1 | 8/2003 |
| WO | 2015/047998 | A1 | 4/2015 |
| WO | 2018/114350 | A1 | 6/2018 |

OTHER PUBLICATIONS

Matlock et al., Polyalkylene Glycols, Chapter 6, Union Carbide Corporation (Year: 1999).*
International Search Report and Written Opinion received for PCT Patent Application No. PCT/EP2020/059319, dated Jul. 1, 2020, 11 pages.
Kovats, et al., "Gas chromatographic characterization of organic substances in the retention index system", Adv. Chromatogr, vol. 1, 1965, pp. 229-247.

* cited by examiner

*Primary Examiner* — Vishal V Vasisth
(74) *Attorney, Agent, or Firm* — Faegre Drinker Biddle & Reath LLP

(57) ABSTRACT

The present invention relates to a method of processing a workpiece comprising contacting a tool and a workpiece to effect a change in the shape of the workpiece, and applying a metalworking fluid to a surface area where the tool and the workpiece are in contact, where the metalworking fluid contains a propoxylate of the formula R—O—$(C_3H_6O)_n$—H, where R is a branched $C_6$ to $C_{20}$ alkyl and n is from 3 to 30. The invention further relates to the metalworking fluid, and to a use of the propoxylate as additive in metalworking fluids.

12 Claims, No Drawings

METALWORKING FLUID CONTAINING A BRANCHED ALCOHOL PROPOXYLATE

CROSS-REFERENCE TO RELATED APPLICATIONS

This application is a national stage application (under 35 U.S.C. § 371) of PCT/EP2020/059319, filed Apr. 1, 2020, which claims benefit of Chinese Application No. PCT/CN2019/082439, filed Apr. 12, 2019, both of which are incorporated herein by reference in their entirety.

The present invention relates to a method of processing a workpiece comprising contacting a tool and a workpiece to effect a change in the shape of the workpiece, and applying a metalworking fluid to a surface area where the tool and the workpiece are in contact, where the metalworking fluid contains a propoxylate of the formula R—O—$(C_3H_6O)_n$—H, where R is a branched $C_6$ to $C_{20}$ alkyl and n is from 3 to 30. The invention further relates to the metalworking fluid, and to a use of the propoxylate as additive in metalworking fluids. Combinations of preferred embodiments with other preferred embodiments are within the scope of the present invention.

Metalworking fluids (MWF) are used in workshops worldwide for the cutting and forming of metals. Their main purposes are to cool and lubricate tools, work pieces and machines, inhibit corrosion and remove swarf.

In the area of MWF the application of minimum quantity lubrication (MQL) has steadily increased. Typically, MQL products are only used in minimal quantities (roughly 1 litre per 8-hour shift) compared with hundreds of cubicmeters flooding the workpiece. If efficiently employed, this form of machining yields dry work pieces and dry chips, which in turn yields a number of benefits over wet machining.

There is an ongoing need to improve various properties of MWF and MQL, e.g. to reduce foaming, to increase storage stability, to reduce the wear scar and to protect machining tools.

The object was solved by a method of processing a workpiece comprising a) contacting a tool and a workpiece to effect a change in the shape of the workpiece, and b) applying a metalworking fluid to a surface area where the tool and the workpiece are in contact, where the metalworking fluid contains a propoxylate of the formula R—O—$(C_3H_6O)_n$—H, where R is a branched $C_6$ to $C_{20}$ alkyl and n is from 3 to 30.

The method of shaping are for example machining, turning, grinding, slitting, shearing, extruding, stamping, profiling, bending, drawing, drilling, punching, planing, tapping, or sawing. Suitable tools for shaping the workpiece are known to an expert and commercially available.

The workpieces can be made of various materials, such as pure metals, metal alloys, nonmetals, composite materials, plastics, refractory materials, ceramics, and other workable materials. A composite material is for example a combination or physical mixture containing two or more materials from the group consisting of pure metals, metal alloys, non-metals, plastics, refractory materials, and ceramics. Preferably, the workpiece is made of pure metals or metal alloys.

The applying of the MWF to the surface area in step b) can be made by spraying, jetting, flooding, misting, dripping or otherwise directing the MWF to contact the surface area. Usually, the MWF penetrates and/or fills the microscopic regions formed by the surface asperities on the tool and/or workpiece.

The MWF should be applied in minimal amounts sufficient to wet or penetrate the surface area and fill in the regions between the asperities on the surface while the MWF is being applied. The amount of the MWF applied to the surface area depends on the method of shaping and the machines and is known to an expert.

In a preferred form the MWF is used for MQL. The metalworking fluid may be applied in a quantity of 5 to 50 ml/h, usually in combination with compressed air.

In another form the MWF is applied in cryogenic cooling, where typically the workpiece is cooled with liquid nitrogen, liquid helium, or solid $CO_2$. During cryogenic machining swarf created by workpiece or grinding tool can be an issue and may need to be removed. Due to the low temperatures of the workpiece, suitable fluids with low pour points are used as removal agents.

The metalworking fluid contains an propoxylate of the formula R—O—$(C_3H_6O)_n$—H, where R is a branched $C_6$ to $C_{20}$ alkyl and n is from 3 to 30.

The propoxylate repeating unit $(C_3H_6O)$ is preferably $(CH_2—CH(CH_3)—O)$. The propoxylate is preferably of the formula R—O—$(CH_2—CH(CH_3)—O)_n$—H.

The index n is preferably a real number from 5 to 25, in particular from 6 to 20. In one form n is from 6 to 10. In another form n is from 12 to 18.

R may contain linear $C_6$ to $C_{20}$ alkyl in addition to the branched alkyl. Usually, R contains less than 30 mol %, 20 mol % or 5 mol % of linear alkyl.

R is preferably a branched $C_8$ to $C_{16}$ alkyl, in particular a $C_{12}$ to $C_{14}$ alkyl. R may contain a mixture of the branched alkyl. In another form R is a branched $C_{10}$ to $C_{13}$ alkyl. In a preferred form R is branched $C_{13}$ alkyl or branched $C_{10}$ alkyl. In another preferred form R is 2-propylheptyl. In another preferred form R is a branched $C_{13}$ alkyl.

In a particular form R is a tridecanol mixture which comprises singly, doubly and triply branched tridecanols.

The tridecanol mixture may be obtainable, preferably it is obtained, by hydroformylation and hydrogenation of a mixture of isomeric dodecenes.

The mixture of isomeric dodecenes may be obtainable, preferably it is obtained, by reacting a hydrocarbon mixture comprising butenes on a heterogeneous catalyst.

In a multistage process starting from a hydrocarbon mixture comprising butenes, a first step dimerizes the butenes to give a mixture of isomeric octenes and dodecenes. The main product produced here is the octenes, while the proportion of dodecenes produced is generally from 5 to 20 percent by weight, based on the reactor discharge. The dodecenes are then isolated from the reaction mixture, hydroformylated to give the corresponding C13 aldehydes, and then hydrogenated to give isotridecanols.

It is therefore preferable to obtain the mixture of isomeric dodecenes by bringing a hydrocarbon mixture comprising butenes into contact with a heterogeneous catalyst which comprises nickel oxide. The isobutene content of the hydrocarbon mixture is preferably 5 percent by weight or less, in particular 3 percent by weight or less, particularly preferably 2 percent by weight or below, and most preferably 1.5 percent by weight or less, based in each case on the total butene content. A suitable hydrocarbon stream is what is known as the C4 cut, a mixture composed of butenes and butanes, which is available in large amounts from FCC plants or steam crackers. Particular preference is given to the use of raffinate II as starting material, this being an isobutene-impoverished C4 cut.

One preferred starting material comprises from 50 to 100 percent by weight, preferably from 80 to 95 percent by weight, of butenes, and from 0 to 50 percent by weight, preferably from 5 to 20 percent by weight, of butanes. The following composition of the butene fraction may be given as a general quantitative guideline: 1-butene from 1 to 99 percent by weight cis-2-butene from 1 to 50 percent by weight trans-2-butene from 1 to 99 percent by weight isobutene from 1 to 5 percent by weight.

Catalysts which may be used are catalysts known per se which comprise nickel oxide. Supported nickel oxide catalysts may be used, suitable support materials being silica, alumina, aluminosilicates, aluminosilicates with a phyllosilicate structure, and zeolites. Particularly suitable catalysts are precipitation catalysts obtained by mixing aqueous solutions of nickel salts and silicates, e.g. mixing sodium silicate and nickel nitrate, where appropriate with other constituents, such as aluminum salts, e.g. aluminum nitrate, and calcining.

Particular preference is given to catalysts substantially composed of NiO, $SiO_2$, $TiO_2$ and/or $ZrO_2$, and also, where appropriate, $Al_2O_3$. Most preference is given to a catalyst whose active substantial constituents are from 10 to 70 percent by weight of nickel oxide, from 5 to 30 percent by weight of titanium dioxide and/or zirconium dioxide, and from 0 to 20 percent by weight of aluminum oxide, the remainder, to give 100 percent by weight, being silicon dioxide. A catalyst of this type is obtainable by precipitating the catalyst composition at a pH of from 5 to 9 by adding an aqueous solution comprising nickel nitrate to an alkali metal water glass solution which comprises titanium dioxide and/or zirconium dioxide, filtering, drying and annealing at from 350 to 650 degrees C.

The hydrocarbon mixture comprising butenes is preferably brought into contact with the catalyst at from 30 to 280 degrees C., in particular from 30 to 140 degrees C., and particularly preferably from 40 to 130 degrees C. The pressure here is preferably from 10 to 300 bar, in particular from 15 to 100 bar, and particularly preferably from 20 to 80 bar. This pressure is usefully adjusted so that the olefin-rich hydrocarbon mixture is liquid or in the supercritical state at the temperature selected.

Examples of suitable apparatuses for bringing the hydrocarbon mixture comprising butenes into contact with the heterogeneous catalyst are tube-bundle reactors and shaft furnaces. Shaft furnaces are preferred because the capital expenditure costs are lower. The dimerization may be carried out in a single reactor, where the oligomerization catalyst may have been arranged in one or more fixed beds. Another way is to use a reactor cascade composed of two or more, preferably two, reactors arranged in series, where the butene dimerization in the reaction mixture is driven to only partial conversion on passing through the reactor or reactors preceding the last reactor of the cascade, and the desired final conversion is not achieved until the reaction mixture passes through the last reactor of the cascade. The butene dimerization preferably takes place in an adiabatic reactor or in an adiabatic reactor cascade.

After leaving the reactor or, respectively, the last reactor of a cascade, the dodecenes formed are separated off from the octenes and, where appropriate, from the higher oligomers, and from the unconverted butenes and butanes, in the reactor discharge. The octenes are generally the main product.

In the second step of the process, the dodecenes obtained are converted in a manner known per se into the aldehydes with molecules lengthened by one carbon atom, by hydroformylation using synthesis gas. The hydroformylation takes place in the presence of catalysts dissolved homogeneously in the reaction medium. The catalysts used here are generally compounds or complexes of metals of the transition group VIII, especially compounds or, respectively, complexes of Co, Rh, Ir, Pd, Pt or Ru, these being either unmodified or modified with, for example, amine- or phosphine-containing compounds.

For the purposes of the present invention, the hydroformylation preferably takes place in the presence of a cobalt catalyst, preferably at from 120 to 240 degrees C., in particular from 160 to 200 degrees C., under a synthesis-gas pressure of from 150 to 400 bar, in particular from 250 to 350 bar. The hydroformylation preferably takes place in the presence of water. The mixing ratio of hydrogen to carbon monoxide in the synthesis gas used is preferably in the range from 70:30 to 50:50 percent by volume and in particular from 65:35 to 55:45 percent by volume.

The cobalt-catalyzed hydroformylation process may be carried out as a multistage process which comprises the following 4 stages: preparation of the catalyst (precarbonylation), catalyst extraction, olefin hydroformylation, and catalyst removal from the reaction product (decobaltization). In the first stage of the process, the precarbonylization, the starting material used is an aqueous cobalt salt solution, e.g. cobalt formate or cobalt acetate, which is reacted with carbon monoxide and hydrogen to prepare the catalyst complex ($HCo(CO)_4$) needed for the hydroformylation. In the second stage of the process, the catalyst extraction, the cobalt catalyst prepared in the first stage of the process is extracted from the aqueous phase using an organic phase, preferably using the olefin to be hydroformylated. Besides the olefin, it is sometimes useful to use the reaction products and byproducts from the hydroformylation for catalyst extraction, as long as these are insoluble in water and liquid under the selected reaction conditions. After separation of the phases, the organic phase loaded with the cobalt catalyst is fed to the third stage of the process, the hydroformylation. In the fourth stage of the process, the decobaltization, the organic phase of the reactor discharge is freed from the cobalt carbonyl complexes in the presence of complex-free process water by treatment with oxygen or air. During this, the cobalt catalyst is oxidatively broken down and the resultant cobalt salts are extracted back into the aqueous phase. The aqueous cobalt salt solution obtained from the decobaltization is recirculated into the first stage of the process, the precarbonylation. The crude hydroformylation product obtained may be fed directly to the hydrogenation. As an alternative, a C13 aldehyde fraction may be isolated from this in a usual manner, e.g. by distillation, and fed to the hydrogenation. The formation of the cobalt catalyst, the extraction of the cobalt catalyst into the organic phase, and the hydroformylation of the olefins may also be carried out in a single-stage process in the hydroformylation reactor.

Examples of cobalt compounds which may be used are cobalt(II) chloride, cobalt(II) nitrate, the amine or hydrate complexes of these, cobalt carboxylates, such as cobalt formate, cobalt acetate, cobalt ethylhexanoate, or cobalt naphthenoate, and also the cobalt caprolactamate complex. Under the hydroformylation conditions, the catalytically active cobalt compounds form in situ as cobalt carbonyls. It is also possible to use the carbonyl complexes of cobalt, such as dicobalt octacarbonyl, tetracobalt dodecacarbonyl, or hexacobalt hexadecacarbonyl.

The aldehyde mixture obtained during the hydroformylation is reduced to give primary alcohols. Some degree of reduction generally takes place under the hydroformylation conditions, and the hydroformylation here may also be controlled so that substantially complete reduction takes place. However, the hydroformylation product obtained is generally hydrogenated in another step of the process using hydrogen gas or a gas mixture comprising hydrogen. The hydro-genation generally takes place in the presence of a heterogeneous hydrogenation catalyst. The hydrogenation catalyst used may be any desired catalyst suitable for hydrogenating aldehydes to give primary alcohols. Examples of suitable catalysts available commercially are copper chromite, cobalt, cobalt compounds, nickel, nickel compounds, which may, where appropriate, comprise small amounts of chromium or other promoters, and mixtures of copper, nickel, and/or chromium. The nickel compounds are generally in supported form on support materials such as alumina or kieselguhr. It is also possible to use catalysts comprising precious metals, such as platinum or palladium.

The hydrogenation may take place by the trickle-flow method, where the mixture to be hydrogenated and the hydrogen gas or, respectively, the hydrogen-containing gas mixture are passed, for example concurrently, over a fixed bed of the hydrogenation catalyst. The hydrogenation preferably takes place at from 50 to 250 degrees C., in particular from 100 to 150 degrees C., and at a hydrogen pressure of from 50 to 350 bar, in particular from 150 to 300 bar. Fractional distillation can be used to separate the desired isotridecanol fraction from the C 8 hydrocarbons and higher-boiling products present in the reaction discharge obtained during the hydrogenation.

The resultant isotridecanols particularly preferred for the purposes of the present invention have a characteristic distribution of isomers, which can be defined in more detail by means of gas chromatography, for example. The tridecanol mixture comprises certain percentages of linear or branched tridecanols, where the percentages are determined by gas chromatography. Usually, the percentages are relative to the total area over all of the tridecanols comprised in the mixture analyzed. The gas chromatogram can be divided into three retention regions, for example as described by Kovacs (Z. Anal. Chem. 181, (1961), p. 351; Adv. Chromatogr. 1 (1965), p. 229) with the aid of retention indices ("RI") and using n-undecanol, n-dodecanol, and n-tridecanol as reference substances:

Region 1: Retention index less than 1180

Region 2: Retention index from 1180 to 1217

Region 3: Retention index greater than 1217

The substances present in region 1 are mainly at least triply branched tridecanols, those present in region 2 are mainly doubly branched isotridecanols, and those present in region 3 are mainly singly-branched isotridecanols and/or n-tridecanol. This method gives an adequately precise determination of the composition of isotridecanols by comparing the areas under the corresponding sections of the gas chromatogram curves (percent by area).

The tridecanol mixture comprises 20 to 60%, preferably 25 to 50%, and in particular 40 to 48% of at least triply branched tridecanols.

The tridecanol mixture comprises 10 to 50%, preferably 20 to 45%, and in particular 30 to 40% doubly branched tridecanols.

The tridecanol mixture comprises 5 to 30%, preferably 10 to 25%, and in particular 15 to 20% singly branched and/or linear tridecanols.

In another form the tridecanol mixture comprises 25 to 50% of at least triply branched tridecanols, 20 to 45% doubly branched tridecanols, and 10 to 25% singly branched and/or linear tridecanols.

In another form the tridecanol mixture comprises 40 to 48% of at least triply branched tridecanols, 30 to 40% doubly branched tridecanols, and 15 to 20% singly branched and/or linear tridecanols.

The tridecanol mixture comprises usually at least 85 wt %, preferably at least 95 wt %, and in particular at least 98 wt % of linear or branched tridecanols, for example as determined by gas chromatography.

The tridecanol mixture comprises usually less than 15%, preferably less than 5 wt %, and in particular less than 2 wt % dodecanol, for example as determined by gas chromatography.

The tridecanol mixture comprises usually less than 5%, preferably less than 3 wt %, and in particular less than 1 wt % tetradecanol, for example as determined by gas chromatography.

The density of the tridecanol mixture is generally from 0.8 to 0.9 g/cm$^3$, preferably from 0.82 to 0.86 g/cm$^3$, and particularly preferably from 0.84 to 0.845 g/cm$^3$.

The refractive index $n_D^{20}$ of the tridecanol mixture is generally from 1.4 to 1.5, preferably from 1.44 to 1.46, and particularly preferably from 1.446 to 1.45.

The boiling range of the tridecanol mixture is generally from 230 to 280° C., preferably from 240 to 275° C., and particularly preferably from 250 to 270° C.

The tridecanol mixture has usually a degree of branching in the range from 1.1 to 3.5, preferably from 1.5 to 3.0, and in particular from 1.9 to 2.4, for example as determined by H-NMR.

The propoxylate of the formula R—O—$(C_3H_6O)_n$—H is obtainable by alkoxylation of the corresponding alcohol R—OH with propylene oxide.

Carrying out alkoxylations is known in principle to the person skilled in the art. It is likewise known to the person skilled in the art that the molecular weight distribution of the alkoxylates can be influenced by the reaction conditions, in particular the choice of catalyst.

The alkoxylation may be a base-catalyzed alkoxylation. For this, the alcohol can be admixed in a pressurized reactor with alkali metal hydroxides, preferably potassium hydroxide, or with alkali metal alcoholates, such as, for example, sodium methylate. As the result of reduced pressure (for example <100 mbar) and/or increasing the temperature (30 to 150° C.), water still present in the mixture can be drawn off. The alcohol is then present as the corresponding alcoholate. The system is rendered inert with inert gas (e.g. nitrogen) and the alkylene oxide(s) is/are added stepwise at temperatures of from 60 to 180° C. up to a pressure of max. 10 bar. At the end of the reaction, the catalyst can be neutralized by adding acid (e.g. acetic acid or phosphoric acid) and, if required, can be filtered off. Optionally, the alkoxylation can also be carried out in the presence of a solvent. This can be e.g. toluene, xylene, dimethylformamide or ethylene carbonate.

The alkoxylation of the alcohols can, however, also be undertaken by means of other methods, for example by acid-catalyzed alkoxylation. Furthermore, double hydroxide clays as described in DE 43 25 237 A1, for example, can be used, or it is possible to use double metal cyanide catalysts (DMC catalysts). Suitable DMC catalysts are disclosed, for example, in WO2003/066706 or DE 102 43 361 A1, in particular sections [0029] to [0041], and the literature cited therein. For example, catalysts of the Zn—Co type can be used. To carry out the reaction, the alcohol can be admixed with the catalyst, and the mixture can be dewatered as described above and be reacted with the alkylene oxides as described.

The metalworking fluid may be formulated in various formulations, which can be applied with or without dilution prior to application.

The metalworking fluid can be formulated as

- a straight oil, which contains the at least 80 wt % propoxylate, and which is applied without dilution of water;
- a soluble oil, which contains 30 to 85 wt % mineral oil and up to 20 wt % propoxylate, and which is applied after dilution with water as aqueous emulsion; or
- a semi-synthetic fluid, which contains 5-30 wt % mineral oil, 30-50 wt % water, and up to 20 wt % propoxylate, and which is applied without dilution of water.

In a preferred form the the metalworking fluid is formulated as a straight oil. In another preferred form the the metalworking fluid is formulated as soluble oil. In another preferred form the the metalworking fluid is formulated as semi-synthetic fluid.

Preferably, the metalworking fluid is formulated as straight oil which contains at least 90 wt % propoxylate and optionally an antioxidant. Preferably, the straight oil is free of water.

In another preferred form the metalworking fluid is formulated as soluble oil which contains 30 to 85 wt % mineral oil, up to 30 wt % water, and up to 10 wt % propoxylate.

The mineral oil may selected from the group of base oils of Group I, II, III, IV and V oils according to the definition of the American Petroleum Institute API, or mixtures thereof.

Group I base oils contain less than 90 percent saturates (ASTM D 2007) and/or greater than 0.03 percent sulfur (ASTM D 2622) and have a viscosity index (ASTM D 2270) greater than or equal to 80 and less than 120.

Group II base oils contain greater than or equal to 90 percent saturates and less than or equal to 0.03 percent sulfur and have a viscosity index greater than or equal to 80 and less than 120.

Group III base oils contain greater than or equal to 90 percent saturates and less than or equal to 0.03 percent sulfur and have a viscosity index greater than or equal to 120.

Group IV base oils contain polyalphaolefins. Polyalphaolefins (PAO) include known PAO materials which typically comprise relatively low molecular weight hydrogenated polymers or oligomers of alphaolefins which include but are not limited to C2 to about C32 alphaolefins with the C8 to about C16 alphaolefins, such as 1-octene, 1-decene, 1-dodecene and the like being preferred. The preferred polyalphaolefins are poly-1-octene, poly-1-decene, and poly-1-dodecene.

Group V base oils contain any base oils not described by Groups I to IV. Examples of Group V base oils include alkyl naphthalenes, alkylene oxide polymers, silicone oils, and phosphate esters.

The metalworking fluid may additionally contain additives which are added in order further to improve their fundamental properties. These include: antioxidants, metal deactivators, rust inhibitors, viscosity index improvers, pour point depressants, dispersants, detergents, tackifiers, thixotropic builders, dewatering agents, antifoam agents, demulsifiers, high pressure additives and antiwear additives. Such additives are added in the amounts customary in each case for the purpose, each in the range from 0.01 to 10.0% by weight. Examples of further additives follow:

1. Phenolic antioxidants 1.1. Alkylated monophenols: 2,6-di-tert-butyl-4-methylphenol, 2-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, linear nonylphenols or nonylphenols which are branched in the side chain, e.g. 2,6-dinonyl-4-methylphenol, 2,4-dimethyl-6-(1'-methyl-undec-1'-yl)-phenol, 2,4-dimethyl-6-(1'-methylheptadec-1'-yl)-phenol, 2,4-dimethyl-6-(1'-methyl-tridec-1'-yl)phenol and mixtures thereof 1.2. Alkylthiomethylphenols: 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol 1.3. Hydroquinones and alkylated hydroquinones: 2,6-di-tert-butyl-4-methoxyphenol, 2,5-ditert-butyl-hydroquinone, 2,5-di-tert-amyl-hydroquinone, 2,6-diphenyl-4-octadecyloxyphenol, 2,6-di-tert-butyl-hydroquinone, 2,5-di-tert-butyl-4-hydroxyanisole, 3,5-di-tertbutyl-4-hydroxyanisole, 3,5-di-tert-butyl-4-hydroxyphenylstearate, bis(3,5-di-tert-butyl-4-hydroxyphenyl) adipate 1.4. Tocopherols: α-, β-, γ- or δ-tocopherols and mixtures thereof (vitamin E)

1.5. Hydroxylated thiodiphenyl ethers: 2,2'-thiobis(6-tert-butyl-4-methylphenol), 2,2'-thiobis(4-octylphenol), 4,4'-thiobis(6-tert-butyl-3-methylphenol), 4,4'-thiobis-(6-tert-butyl-2-methylphenol), 4,4'-thiobis(3,6-di-sec-amylphenol), 4,4'-bis(2,6-dimethyl-4-hydroxyphenyl) disulphide 1.6. Alkylidene bisphenols: 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)-phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercaptobutane, ethylene glycol bis[3,3-bis(3'-tert-butyl-4'-hydroxyphenyl)butyrate], bis(3-tert-butyl-4-hydroxy-5-methyl-phenyl)dicyclopentadiene, bis[2-(3'-tert-butyl-2'-hydroxy-5'-methyl-benzyl)-6-tert-butyl-4-methyl-phenyl] terephthalate, 1,1-bis(3,5-dimethyl-2-hydroxyphenyl)-butane, 2,2-bis(3,5-di-tert-butyl-4-hydroxyphenyl)propane, 2,2-bis(5-tert-butyl-4-hydroxy-2-methylphenyl)-4-n-dodecylmercaptobutane, 1,1,5,5-tetra(5-tert-butyl-4-hydroxy-2-methylphenyl)pentane 1.7. O-, N- and S-benzyl compounds: 3,5,3',5'-tetra-tert-butyl-4,4'-dihydroxydibenzyl ether, octadecyl 4-hydroxy-3,5-dimethylbenzylmercaptoacetate, tridecyl-4-hydroxy-3,5-di-tertbutylbenzylmercaptoacetate, tris(3,5-di-tert-butyl-4-hydroxybenzyl)amine, bis(4-tertbutyl-3-hydroxy-2,6-dimethylbenzyl) dithioterephthalate, bis(3,5-di-tert-butyl-4-hydroxybenzyl) sulphide, isooctyl 3,5-di-tert-butyl-4-hydroxybenzylmercaptoacetate 1.8. Hydroxybenzylated malonates: dioctadecyl 2,2-bis(3,5-di-tert-butyl-2-hydroxybenzyl)malonate, dioctadecyl 2-(3-tert-butyl-4-hydroxy-5-methylbenzyl)malonate, didodecyl mercaptoethyl-2,2-bis(3,5-di-tert-butyl-4-hydroxybenzyl)malonate, di-[4-(1,1,3,3-tetramethylbutyl)-phenyl]-2,2-bis(3,5-di-tert-butyl-4-hydroxybenzyl)malonate 1.9. Hydroxybenzyl aromatics: 1,3,5-tris(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol 1.10. Triazine compounds: 2,4-bisoctylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tertbutyl-4-hydroxyphenoxy)-1,2,3-triazine, 1,3,5-tris(3,5-di-tert-butyl-4-hydroxybenzyl) isocyanurate, 1,3,5-tris(4-tert-butyl-3-hydroxy-2,6-dimethylbenzyl) isocyanurate, 2,4,6-tris(3,5-di-tert-butyl-4-hydroxyphenylethyl)-1,3,5-triazine, 1,3,5-tris(3,5-di-tert-butyl-4-hydroxyphenylpropionyl)-hexahydro-1,3,5-triazine, 1,3,5-tris(3,5-dicycdohexyl-4-hydroxybenzyl) isocyanurate 1.11. Acylaminophenols: 4-hydroxylauranilide, 4-hydroxystearanilide, octyl N-(3,5-di-tert-butyl-4-hydroxyphenyl) carbamate 1.12. Esters of beta-(3,5-di-tert-butyl-4-hydroxyphenyl)-propionic acid with monohydric or polyhydric alcohols, e.g. with methanol, ethanol, n-octanol, isooctanol, octadecanol, 1,6-hexanediol, 1,9-nonanediol, ethylene glycol, 1,2-propanediol, neopentylglycol, thiodiethylene glycol, diethylene glycol, triethylene glycol, pentaerythritol, tris (hydroxyethyl) isocyanurate, N,N'-bis(hydroxyethyl)oxalamide, 3-thiaundecanol, 3-thiapentadecanol, trimethylhexanediol, trimethylolpropane, 4-hydroxymethyl-1-phospha-2,6,7-trioxabicyclo[2.2.2]octane 1.13. Esters of beta-(5-tert-butyl-4-hydroxy-3-methylphenyl)propionic acid (with monohydric or polyhydric alcohols), e.g. the alcohols with methanol, ethanol, n-octanol, isooctanol, octadecanol, 1,6-hexanediol, 1,9-nonanediol, ethylene glycol, 1,2-propanediol, neopentylglycol, thiodiethylene glycol, diethylene glycol, triethylene glycol, pentaerythritol, tris(hydroxyethyl) isocyanurate, N,N'-bis (hydroxyethyl)-oxalamide, 3-thiaundecanol, 3-thiapentadecanol, trimethylhexanediol, trimethylolpropane, 4-hydroxymethyl-1-phospha-2,6,7-trioxabicyclo[2.2.2]octane 1.14. Esters of beta-(3,5-dicycdohexyl-4-hydroxyphenyl) propionic acid with monohydric or polyhydric alcohols, e.g. the alcohols stated under 13

1.15. Ester of 3,5-di-tert-butyl-4-hydroxyphenylacetic acid with monohydric or polyhydric alcohols, e.g. the alcohols stated under 13

1.16. Amides of beta-(3,5-di-tert-butyl-4-hydroxyphenyl) propionic acid, e.g. N,N'-bis(3,5-di-tertbutyl-4-hydroxyphenylpropionyl)hexamethylenediamine, N,N'-bis(3,5-di-tert-buty-4-hydroxyphenylpropionyl) trimethylenediamine, N,N'-bis(3,5-di-tert-butyl-4-hydroxyphenylpropionyl)hydrazine 1.17. Ascorbic acid (vitamin C)

1.18. Amine antioxidants: N,N'-diisopropyl-p-phenylenediamine, N,N'-di-sec-butyl-p-phenylenediamine, N,N'-bis (1,4-dimethylpentyl)-p-phenylenediamine, N,N'-bis(1-ethyl-3-methylpentyl)-p-phenylenediamine, N,N'-bis(1-methyl-heptyl)-p-phenylenediamine, N,N'-dicyclohexyl-p-phenylenediamine, N,N'-diphenyl-p-phenylenediamine, N,N'-di-(naphth-2-yl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulphonamido) diphenylamine, N,N'-dimethyl-N,N'-di-sec-butyl-p-phenylenediamine, diphenylamine, N-allyldiphenylamine, 4-isopropoxy-diphenylamine, N-phenyl-1-naphthylamine, N-(4-tert-octylphenyl)-1-naphthylamine, N-phenyl-2-naphthylamine, octylated diphenylamine, e.g. p,p'-di-tertoctyldiphenylamine, 4-n-butylaminophenol, 4-butyrylaminophenol, 4-nonanoylaminophenol, 4-dodecanoylaminophenol, 4-octadecanoylaminophenol, di-(4-methoxyphenyl)amine, 2,6-di-tert-butyl-4-dimethylaminomethylphenol, 2,4'-diaminodiphenylmethane, 4,4'-diaminodiphenylmethane, N,N,N',N'-tetramethyl-4,4'-diaminodiphenylmethane, 1,2-di-[(2-methyl-phenyl)-amino]ethane, 1,2-di-(phenylamino)-propane, (o-tolyl)biguanide, di[4-(1',3'-dimethyl-butyl)phenyl]amine, tert-octylated N-phenyl-1-naphthylamine, mixture of mono- and dialkylated tert-butyl/tert-octyldiphenylamines, mixture of mono- and dialkylated nonyldiphenylamines, mixture of mono- and dialkylated dodecyldiphenylamines, mixture of mono- and dialkylated isopropy/isohexyldiphenylamines, mixtures of mono- and dialkylated tert-butyldiphenylamines, 2,3-dihydro-3,3-dimethyl-4H-1,4-benzothiazine, phenothiazine, mixture of mono- and dialkylated tert-butyl tert-octylphenothiazines, mixture of mono- and dialkylated tert-octylphenothiazines, N-allylphenothiazine, N,N,N',N'-tetraphenyl-1,4-diaminobut-2-ene, N,N-bis-(2,2,6,6-tetramethylpiperidin-4-yl)-hexamethylenediamine, bis-(2,2,6,6-tetramethylpiperidin-4-yl) sebacate, 2,2,6,6-tetramethylpiperidin-4-one, 2,2,6,6-tetramethylpiperidin-4-ol 2. Further antioxidants: aliphatic or aromatic phosphites, esters of thiodipropionic acid or thiodiacetic acid or salts of dithiocarbamic or dithiophosphoric acid, 2,2,12,12-tetramethyl-5,9-dihydroxy-3,7,11-trithiatridecane and 2,2,15,15-tetramethyl-5,12-dihydroxy-3,7,10,14-tetrathiahexadecane 3. Further metal deactivators:

3.1. Benzotriazoles and derivatives thereof: 2-mercaptobenzotriazole, 2,5-dimercaptobenzotriazole, 4- or 5-alkylbenzotriazoles (e.g. tolutriazole) and derivatives thereof, 4,5,6,7-tetrahydrobenzotriazole, 5,5'-methylenebisbenzotriazole; Mannich bases of benzotriazole or tolutriazole, such as 1-[di(2-ethylhexylaminomethyl)]tolutriazole and 1-[di(2-ethylhexylaminomethyl)]benzotriazole; alkoxyalkylbenzotriazoles, such as 1-(nonyloxymethyl)benzotriazole, 1-(1-butoxyethyl)benzotriazole and 1-(1-cyclohexyloxybutyl)tolutriazole 3.2. 1,2,4-Triazoles and derivatives thereof: 3-alkyl (or aryl)-1,2,4-triazoles, Mannich bases of 1,2,4-triazoles, such as 1-[di(2-ethylhexyl)aminomethyl]-1,2,4-triazole; alkoxyalkyl-1,2,4-triazoles, such as 1-(1-butoxyethyl)-1,2,4-triazole; acylated 3-amino-1,2,4-triazoles 3.3. Imidazole derivatives: 4,4'-methylenebis(2-undecyl-5-methylimidazole), bis[(N-methyl)imidazol-2-yl]carbinol octyl ether 3.4. Sulphur-containing heterocyclic compounds: 2-mercaptobenzothiazole, 2,5-dimercapto-1,3,4-thiadiazole, 2,5-dimercaptobenzothiadiazole and derivatives thereof; 3,5-bis[di-(2-ethylhexyl)aminomethyl]-1,3,4-thiadiazolin-2-one 3.5. Amino compounds: salicylidenepropylenediamine, salicylaminoguanidine and salts thereof 4. Corrosion inhibitors:

4.1. Organic acids, their esters, metal salts, amine salts and anhydrides: alkyl- and alkyenylsuccinic acids and partial esters thereof with alcohols, diols or hydroxycarboxylic acids, partial amides of alkyl- and alkenylsuccinic acids, 4-nonylphenoxyacetic acid, alkoxyand alkoxyethoxycarboxylic acids, such as dodecyloxyacetic acid, dodecyloxy (ethoxy)acetic acid and amine salts thereof, sorbitan monooleate, sodium monooleate, lead naphthenate, alkenylsuccinic anhydrides, e.g. dodecenylsuccinic anhydride, 2-(2-carboxyethyl)-1-dodecyl-3-methylglycerol and salts thereof, in particular sodium salts and triethanolamine salts 4.2. Nitrogen-containing compounds:

4.2.1 Tertiary aliphatic and cycloaliphatic amines and amine salts of organic and inorganic acids, e.g. oil-soluble alkylammonium carboxylates, and furthermore 1-[N,N-bis-(2-hydroxyethyl)amino]-3-(4-nonylphenoxy)propan-2-ol 4.2.2 Heterocyclic compounds, e.g. substituted imidazolines and oxazolines, e.g. 2-heptadecenyl-1-(2-hydroxyethyl)-imidazoline 5. Sulphur-containing compounds: barium dinonylnaphthalenesulphonates, calcium petroleum sulphonates, alkylthio-substituted aliphatic carboxylic acids, esters of aliphatic 2-sulphocarboxylic acids and salts thereof 6. Viscosity index improvers: polyacrylates, polymethacrylates, vinylpyrrolidone/methacrylate copolymers, polyvinylpyrrolidiones, polybutenes, olefin copolymers, styrene/acrylate copolymers, polyethers 7. Pour point depressants: poly(meth)acrylates, ethylene-vinyl acetate copolymers, alkyl polystyrenes, fumarate copolymers, alkylated naphthalene derivatives 8. Dispersants/Surfactants: polybutenylsuccinamides or polybutenylsuccinimides, polybutenylphosphonic acid derivatives, basic magnesium, calcium and barium sulphonates and phenolates 9. High pressure and antiwear additives: sulphur- and halogen-containing compounds, e.g. chlorinated paraffins, sulphonated olefins or vegetable oils (soy bean oil, rapeseed oil), alkyl or aryl di- or trisulphides, benzotriazoles or derivatives thereof, such as bis (2-ethylhexyl)aminomethyl tolutriazoles, dithiocarbamates, such as methylenebisdibutyl dithiocarbamate, derivatives of 2-mercaptobenzothiazole, such as 1-[N,N-bis(2-ethylhexyl) aminomethyl]-2-mercapto-1H-1,3-benzothiazole, derivatives of 2,5-dimercapto-1,3,4-thiadiazole, such as 2,5-bis(tert.nonyldithio)-1,3,4-thiadiazole 10. Substances for reducing the coefficient of friction: lard oil, oleic acid, tallow, rapeseed oil, sulphurised fats, amines.

11. Special additives for use in water/oil fluids:

11.1 Emulsifiers: petroleum sulphonates, amines, such as polyoxyethylated fatty amines, non-ionic surface-active substances 11.2 Buffers: alkanolamines 11.3 Biocides: triazines, thiazolinones, trisnitromethane, morpholine, sodium pyridinethiol 11.4 Processing speed improvers: calcium sulphonates and barium sulphonates 11.5 Tackifiers: acrylamide copolymer, polyisubutene resins.

11.6 Thixotropic builders: microcrystalline waxes, oxidized waxes and oxidized esters 11.7 Dewatering agents: polyglycol ethers, butyldiglycols.

The invention also relates to the metalworking fluid as defined above.

The invention also relates to a use of the propoxylate as additive in metalworking fluids.

EXAMPLES

Example 1—Tridecanol Mixture

A technical mixture of tridecanol was prepared as described in US 2003/0187114 starting from a technical $C_4$-raffinate. A technical mixture of butane and butenes isomers was subjected to dimerization on a heterogeneous catalyst to produce a mixture of octene isomers and dodecene isomers. The dodecene isomers were separated by distillation. The isomeric dodecenes were hydroformylated with synthesis gas comprising hydrogen and carbon monooxide, and subsequently hydrogenated with hydrogen. The resulting tridecanol mixture was isolated by fractional distillation.

The density of the tridecanol mixture was 0.843 g/cm$^3$, the refractive index $n_D^{20}$ was 1.448, the viscosity was 34.8 mPas, and the boiling range was from 251 to 267° C. (according to DIN 51751).

The fraction of the tridecanol isomers was at least 99.0% by area as determined by gas chromatography according to DIN 55685. The content of dodecanol and of tetradecanol was each below 1% by area as determined by gas chromatography.

The tridecanol mixture was analyzed by gas chromatography as described in US 2003/0187114 using the Kovacs method: A specimen of the isotridecanol was trimethylsilylated using 1 ml of N-methyl-N-trimethylsilyltrifluoroacetamide per 100 μl of specimen for 60 minutes at 80° C. For separation by gas chromatography use was made of a Hewlett Packard Ultra 1 separating column of 50 m in length, based on 100%-methylated silicone rubber, with an internal diameter of 0.32 mm. Injector temperature and detector temperature were 250° C. and the oven temperature was 160° C. (isothermal). The split was 80 ml/min. The carrier gas was nitrogen. The inlet pressure was set to 2 bar. 1 μl of the specimen was injected into the gas chromatograph, and the separated constituents were detected by means of FID.

The reference substances used here were n-undecanol: Retention index ("RI") 1100; n-dodecanol: Retention index 1200; and n-tridecanol Retention index 1300. For evaluation purposes the gas chromatogram was subdivided into the following regions:

Region 1: Retention index less than 1180

Region 2: Retention index from 1180 to 1217

Region 3: Retention index greater than 1217

The areas of the tridecanol peaks were set to 100 percent by area. The results are summarized in Table A.

TABLE A

| Retention index | Branching | Tridecanol Mixture |
|---|---|---|
| less than 1180 | at least triply branched | 46% |
| 1180 to 1217 | doubly branched | 35% |
| greater than 1217 | singly branched and/or linear | 19% |

Example 2—Propoxylates

Propoxylate A

In a 2 L-autoclave a double metal cyanide (DMC) catalyst (23 mg, prepared according to WO 2003/066706, page 13-14) was suspended in the Tridecanol Mixture (170.3 g). The reactor was closed and three vacuum purge cycles were applied. The mixture was then heated to 135° C. At this temperature propylene oxide (740.5 g) was added steadily over a period of 6.25 h. Afterwards the mixture was stirred for another 5 h at the same temperature and finally cooled down to room temperature. The product (900 g) was obtained as a light yellow oil.

Propoxylate A was obtained having on average 15 propylene oxide units, acid value 0.24 (DGF C-V 2), pour point −51° C. (DIN ISO 3016), kinematic viscosity at 40° C. of 56 $mm^2/s$, kinematic viscosity at 100° C. of 10 $mm^2/s$ (ASTM D 445).

Propoxylate B

A solution of KOH (8 g) in water (8 g) was added to the Tridecanol Mixture (1200 g) and stirred in a round-bottom flask for 2 h at 100° C. under vacuum. Afterwards the mixture was filled into an autoclave and heated to 130° C. Propylene oxide (2788 g) was then added over a period of 66 h, the mixture was stirred for an additional 6 h and cooled to 100° C. A magnesium silicate absorber (120 g) was added, the mixture was stirred for 2 h at 100° C. and then filtered. The product (3980 g) was obtained as a light yellow oil.

Propoxylate B was obtained having on average 8 propylene oxide units, acid value 0.1, pour point −54° C., kinematic viscosity at 40° C. of 29 $mm^2/s$, kinematic viscosity at 100° C. of 6 $mm^2/s$.

Propoxylate C

The Propoxylate C was prepared according to Propoxylate A and B based on a 2-propylheptanol. Propoxylate C was obtained having on average 8 propylene oxide units

Example 3—Application Tests

The application test were made as describe below and the results summarized in Table 1. For comparison a commercially available Synative® AL G 16 (a 2-hexyldecan-1-ol guerbet alcohol) was used (pour point −60° C., kinematic viscosity at 40° C. of 19 $mm^2/s$, kinematic viscosity at 100° C. of 2.8 $mm^2/s$). The following test methods were used:

Reichert Wear Scar tested as 20 wt % in Nynas® T22 (mid viscosity hydrotreated naphthenic oil for metalworking fluids, KV40 about 22 cSt). The Reichert wear tester consists of two cylinders made of stainless steel (V2A). One is used as the stationary wear member and the second cylinder as the rotating wear member that operates at 90 degrees to the stationary member. The fluid reservoir is filled with a 1 percent solution of the test-substance in water. After 100 m the rotation is stopped, metal-cylinders are washed with ethanol and the wear-scar of the stationary wear member is analysed (measured in $mm^2$).

KV40 (20 wt % in oil): kinematic viscosity at 40° C. of a 20 wt % solution in Nynas® T22.

KV100 (20 wt % in oil): kinematic viscosity at 100° C. of a 20 wt % solution in Nynas® T22.

The results showed improvements with regard to a reduced wear scar and an increased VI.

TABLE 1

| | Propoxylate A | Propoxylate B | Propoxylate C | Synative ® AL G16 (comparative) |
|---|---|---|---|---|
| Reichert Wear Scar | 26 $mm^2$ | 30 $mm^2$ | 29 $mm^2$ | 35 $mm^2$ |
| KV40 (20 wt % in oil) | 26 $mm^2/s$ | 22 $mm^2/s$ | 21 $mm^2/s$ | 18 $mm^2/s$ |
| KV100 (20 wt % in oil) | 4.5 $mm^2/s$ | 4 $mm^2/s$ | 3.8 $mm^2/s$ | 3.1 $mm^2/s$ |
| Viscosity Index | 76 | 48 | 45 | 42 |

Example 4—Formulation Stability

A typical metalworking fluid formulation was prepared comprising the following commercially available components listed in Table 2. In addition the formulations contained 1.5% of Propoxylate A, B or the comparative Synative® AL G16.

TABLE 2

| Component | Amount [%] |
|---|---|
| Monoethanol Amine | 9.1 |
| Triethanolamine | 2 |
| Irgacor ® L190Plus | 4.1 |
| Deionized water | 10.3 |
| Tall Oil Fatty Acid (25/30) | 5.2 |
| Ricinoleic acid | 7 |
| complex ester based on fatty acids | 2.2 |
| Synative ® AC 3499 | 1 |
| Synative ® AC 3370 V | 3 |
| Synative ® EP 5 LV | 5.6 |
| NYNAS ® T 22 | 49 |

The stability of this metalworking fluid formulation was tested by storing the liquid at room temperature for 2 months at 40° C. followed by 12 months at room temperature ("Long Term"). The visual inspection showed clear liquids at the end of the test periods.

TABLE 3

| | Start | Long Term |
|---|---|---|
| Synative ® AL G16 (comparative) | clear | clear |
| Propoxylate A | clear | clear |
| Propoxylate B | clear | clear |

Example 5—Foaming

The formulation of example 4 was diluted with tap water to produce a transparent emulsion containing 5 wt % of the formulation. The shaking foam was evaluated as follows: In a 100 ml graduated cylinder with stopper 70 ml of the diluted formulation was carefully filled without generating foam. The the cylinder was shaken 20 times up and down, where one up-down-up process is recorded as one time. The maximum foam height was recorded immediately as the start time and the time intervals given in Table 4.

The data demonstrated that the Propoxylate A, B and C generated less foaming that the comparative formulations.

TABLE 4

| Amount of Foam [ml] | | | | |
|---|---|---|---|---|
| | Propoxylate A | Propoxylate B | Propoxylate C | Synative ® AL G16 (comparative) |
| Start | 25 | 26 | 34 | 40 |
| 1 min | 5 | 24 | 28 | 38 |
| 2.2 min | 0 | — | — | — |
| 3 min | — | 3 | 8 | 16 |
| 3.5 min | — | 0 | — | — |
| 5 min | 0 | 0 | 4 | 6 |

Example 6

The pour point of the Propoxylates A, B and C was measured (DIN ISO 3016) and compared to C16/18 Propoxylate with 2.2 ethylene oxide units. The data in Table 5 demonstrated a very low pour point.

TABLE 5

| | Propoxylate A | Propoxylate B | Propoxylate C | C16/18 Propoxylate (comparative) |
|---|---|---|---|---|
| Pour Point | −51° C. | −54° C. | −62° C. | 14° C. |

Example 7

Samples of the Propoxylate A, B or the comparative Synative® AL G16 were put with aluminum pans into an oven and heated up to 350° C. within 30 min, and then kept for 2 h at 350° C. Then the ash was determined and calculated by weight percent. The data in Table 6 demonstrated that the Propoxylate A and B had a cleaner burn off.

TABLE 6

| | Propoxylate A | Propoxylate B | Synative ® AL G16 (comparative) |
|---|---|---|---|
| Ash | 0.12 wt % | 0.10 wt % | 0.34 wt % |

The invention claimed is:

1. A method of processing a workpiece comprising a) contacting a tool and a workpiece to effect a change in the shape of the workpiece, and b) applying a metalworking fluid to a surface area where the tool and the workpiece are in contact, where the metalworking fluid contains a propoxylate of the formula $R—O—(CH_2—CH(CH_3)—O)_n—H$, where R is a branched $C_{10}$ to $C_{13}$ alkyl and n is from 5 to 25, and wherein the metalworking fluid is formulated as a straight oil, which contains the at least 80 wt % of a propoxylate, and which is applied without dilution of water;

a soluble oil, which contains 30 to 85 wt % mineral oil and up to 20 wt % propoxylate, and which is applied after dilution with water as aqueous emulsion; or a semi-synthetic fluid, which contains 5-30 wt % mineral oil, 30-50 wt % water, and up to 20 wt % propoxylate, and which is applied without dilution of water.

2. The method according to claim 1 where R is a branched $C_{13}$ alkyl.

3. The method according to claim 1 where R is a tridecanol mixture, which comprises singly, doubly and triply branched tridecanols.

4. The method according to claim 3 where the tridecanol mixture comprises 20 to 60% of at least triply branched tridecanols, 10 to 50% doubly branched tridecanols, and 5 to 30% singly branched and/or linear tridecanols, and where the percentages are determined by gas chromatography.

5. The method according to claim 1 where the metalworking fluid is formulated as straight oil which contains at least 90 wt % propoxylate and optionally an antioxidant.

6. The method according to claim 1 where the metalworking fluid is formulated as soluble oil which contains 30 to 85 wt % mineral oil, up to 30 wt % water, and up to 10 wt % propoxylate.

7. The method according to claim 1 where the metalworking fluid is applied in a quantity of 5 to 50 ml/h.

8. The method according to claim 1 where the workpiece is made of pure metals or metal alloys.

9. A metalworking fluid as defined in claim 1.

10. A method comprising utilizing the propoxylate as defined in claim 1 as additive in metalworking fluids.

11. The method according to claim 1, wherein R is branched $C_{13}$ alkyl or branched $C_{10}$ alkyl.

12. The method according to claim 1, wherein R is 2-propyl-heptyl.

* * * * *